US011619013B1

(12) United States Patent
Mashek et al.

(10) Patent No.: US 11,619,013 B1
(45) Date of Patent: Apr. 4, 2023

(54) MILLING MACHINE HAVING A TIP OVER WARNING SYSTEM

(71) Applicant: CATERPILLAR PAVING PRODUCTS INC., Brooklyn Park, MN (US)

(72) Inventors: Nathan L. Mashek, Albertville, MN (US); Dario Sansone, Bologna (IT); Nathaniel S. Doy, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 17/490,320

(22) Filed: Sep. 30, 2021

(51) Int. Cl.
*E01C 23/088* (2006.01)
*E01C 23/12* (2006.01)
*E01C 23/06* (2006.01)

(52) U.S. Cl.
CPC ..... *E01C 23/088* (2013.01); *E01C 23/065* (2013.01); *E01C 23/127* (2013.01)

(58) Field of Classification Search
CPC .... E01C 23/065; E01C 23/088; E01C 23/127; E02F 3/16; E02F 3/26; E02F 9/163; E02F 9/24; B62D 49/08; B60R 16/0233; B60R 2021/01013; B60R 21/013; B60R 2021/01306; B60R 2021/01308; B60R 2021/01313; B60R 21/0132; B60R 2021/01322
USPC ..... 299/1.5
See application file for complete search history.

(56) References Cited

U.S. PATENT DOCUMENTS

| | | | | |
|---|---|---|---|---|
| 8,275,516 | B2 | 9/2012 | Murphy | |
| 8,902,055 | B2 | 12/2014 | Holbert et al. | |
| 10,642,265 | B2 | 5/2020 | O'Donnell et al. | |
| 2012/0209502 | A1* | 8/2012 | Nichols | B62D 53/021 701/124 |
| 2016/0177522 | A1* | 6/2016 | Nacke | B60G 17/016 299/1.5 |
| 2017/0100981 | A1* | 4/2017 | Muir | B60G 17/01908 |
| 2017/0130407 | A1* | 5/2017 | Laux | B62D 65/02 |
| 2020/0089230 | A1 | 3/2020 | Oetken et al. | |
| 2020/0123716 | A1* | 4/2020 | Engelmann | E01C 23/088 |

(Continued)

FOREIGN PATENT DOCUMENTS

EP 2192014 A2 6/2010

*Primary Examiner* — Abby J Flynn
*Assistant Examiner* — Michael A Goodwin
(74) *Attorney, Agent, or Firm* — Finnegan, Henderson, Farabow, Garrett & Dunner, LLP

(57) ABSTRACT

A milling machine may have a frame extending along a longitudinal axis and a milling drum attached to the frame. The milling machine may have ground engaging tracks that support the frame, and height-adjustable leg columns connecting the frame to the tracks. The milling machine may also have an engine for rotating the milling drum and propelling the ground engaging tracks. The milling machine may have a slope sensor to measure a roll angle of the frame, a speed sensor to measure a ground speed, and a configuration sensor to measure a machine configuration parameter. The milling machine may also have an alarm device and a controller. The controller may determine a threshold roll angle based on the machine configuration parameter, compare the roll angle with the threshold roll angle, and activate the alarm device when the roll angle is greater than or equal to the threshold roll angle.

20 Claims, 6 Drawing Sheets

(56) References Cited

U.S. PATENT DOCUMENTS

| | | | | |
|---|---|---|---|---|
| 2020/0172087 | A1 | 6/2020 | Shur et al. | |
| 2020/0263366 | A1* | 8/2020 | Schlenker | G05D 1/0891 |
| 2020/0404842 | A1* | 12/2020 | Dugas | A01D 45/10 |

* cited by examiner

MILLING MACHINE HAVING A TIP OVER WARNING SYSTEM

TECHNICAL FIELD

The present disclosure relates generally to a milling machine and, more particularly, to a milling machine having a tip over warning system.

BACKGROUND

Road surfaces typically include an uppermost layer of asphalt or concrete on which vehicles travel. Over time, a road surface may wear out or may be damaged, for example, due to the formation of potholes or development of cracks and ruts. The damaged road surface may in turn cause damage to vehicles travelling on the road surface. The damaged road surface can be repaired locally by filling up the potholes, cracks, and/or ruts. However, it is often desirable to replace the worn or damaged road surface with an entirely new road surface. This is usually accomplished by removing a layer of the asphalt or concrete from the roadway and repaving the roadway by laying down a new layer of asphalt or concrete.

A milling machine is often used to remove the layer of asphalt or concrete on the roadway surface. A typical milling machine includes a frame supported on wheels or tracks and includes a milling drum attached to the frame. As the milling machine is driven over the existing roadway surface, teeth or cutting tools on the rotating milling drum come into contact with the roadway surface and tear up a layer of the roadway. A milling drum chamber typically encloses the milling drum to contain the milled material. The milled material is typically transported using a conveyor system to an adjacent vehicle, which removes the material from the worksite. Following the milling process, a new layer of asphalt or concrete may be applied on the milled road surface to create a new roadway surface.

In another application, it is sometimes desirable to stabilize or reconstitute the upper layer of a roadway or a worksite. This is usually accomplished by removing the upper layer, mixing it with stabilizing components such as cement, ash, lime, etc., and depositing the mixture back on top of the roadway or worksite. A milling machine, such as a stabilizer or reclaimer is often used for this purpose. Such milling machines also include a frame supported by tracks or wheels and include a milling drum attached to the frame. The milling drum is enclosed in a drum chamber. The cutting tools or teeth on the milling drum tear up the ground and push the removed material toward a rear of the drum chamber. Stabilizing ingredients and/or water are mixed with the milled material, which is then deposited back on to the ground towards the rear of the drum chamber.

Both types of milling machines discussed above often work on ground surfaces that may have a significant amount of cross-slope or lateral inclination. Further, in both types of milling machines discussed above, the frame is typically located several feet above the ground. As a result these machines may have a relatively high center of gravity. Moreover, some of the milling machines may have a conveyor slewed to one side or the other of the milling machine to direct the material removed from the ground surface to a truck traveling alongside the machine. The cross-slope, high center of gravity, and slewing of the conveyor may lead to unexpected tipping over of the milling machine, which may damage the machine, the ground surface, and/or objects around the machine. It is, therefore, desirable to provide a tip over warning system that may alert an operator of the milling machine to the possibility of a tip over condition, allowing the operator to take corrective measures to prevent such tip over.

U.S. Pat. No. 8,275,516 of Murphy, issued on Sep. 25, 2012 ("the '516 patent") and discloses a rollover risk assessment system for estimating rollover risk associated with maneuvering an agricultural tractor on varying terrain. The rollover risk assessment system of the '516 patent identifies a stability baseline as a trapezoidal area defined by the positions where the wheels of the tractor touch the ground surface. The system determines a center of gravity for the tractor based on the type of tractor, attached implements and accessories, and/or tire pressure. The system also determines angle θ between a vertical direction and the tractor z-axis using the tractor's roll angle sensors. Further, the system of the '516 patent determines a position of the center of gravity relative to the stability baseline based on angle θ. The system of the '516 patent causes visual or audible alerts to be issued based on the location of the center of gravity relative to the stability baseline. The system of the '516 patent also discloses a display that shows the determined angle θ relative to warning lines (or angles) that indicate limits of safe operation. The '516 patent discloses that the warning lines may move depending on tractor speed and that high angles θ may be tolerable at low speed.

Although the rollover risk assessment system of the '516 patent discloses a warning system to alert an operator of a tractor when the tractor is likely to roll over, it may still be less than optimal. For example, although the system of the '516 patent may adjust the warning lines based on tractor speed, the disclosed system still does not account for changes in the machine configuration that may occur during operation of the machine. For example, the disclosed system of the '516 patent does not adjust the threshold angles or stability baseline based on changes in the configuration of the tractor caused by, for example, position of various implements, weights associated with those implements, etc. Furthermore, the disclosed system of the '516 patent does not adjust the threshold angles or stability baseline based on changes to the tractor configuration or changes in weight distribution that may occur during operation of the tractor.

The milling machines and/or the tip over warning system of the present disclosure solve one or more of the problems set forth above and/or other problems of the prior art.

SUMMARY

In one aspect, the present disclosure is directed to a milling machine. The milling machine may include a frame having a longitudinal axis. The milling machine may also include a milling drum attached to the frame and extending along a transverse axis of the frame. Further, the milling machine may include a plurality of ground engaging tracks configured to support the frame, and a plurality of height-adjustable leg columns connecting the frame to the tracks. The milling machine may also include an engine configured to rotate the milling drum and propel the ground engaging tracks. The milling machine may include a slope sensor configured to measure a roll angle of the frame, a speed sensor configured to measure a ground speed of the milling machine, and a configuration sensor configured to measure a machine configuration parameter. The milling machine may also include an alarm device and a controller. The controller may be configured to determine a threshold roll angle based on the machine configuration parameter. The controller may also be configured to compare the roll angle with the threshold roll angle. In addition, the controller may be configured to activate the alarm device when the roll angle is greater than or equal to the threshold roll angle.

In another aspect, the present disclosure is directed to a method of operating a milling machine. The milling machine may include a frame having a longitudinal axis and supported by a plurality of ground engaging tracks connected to the frame by a plurality of height adjustable leg columns, a milling drum attached to the frame, a speed sensor, a slope sensor, a configuration sensor, and a controller. The method may include operating one or more of the leg columns to adjust a position of the frame relative to a ground surface. The method may also include determining a roll angle of the frame based on a signal from the slope sensor. Further, the method may include determining a machine configuration parameter based on a signal from the configuration sensor. The method may also include determining, using the controller, a threshold roll angle based on the machine configuration parameter. The method may include comparing, using the controller, the determined roll angle of the frame with the threshold roll angle. In addition, the method may include activating an alarm device when the determined roll angle is greater than or equal to the threshold roll angle.

DETAILED DESCRIPTION

Figure 1:
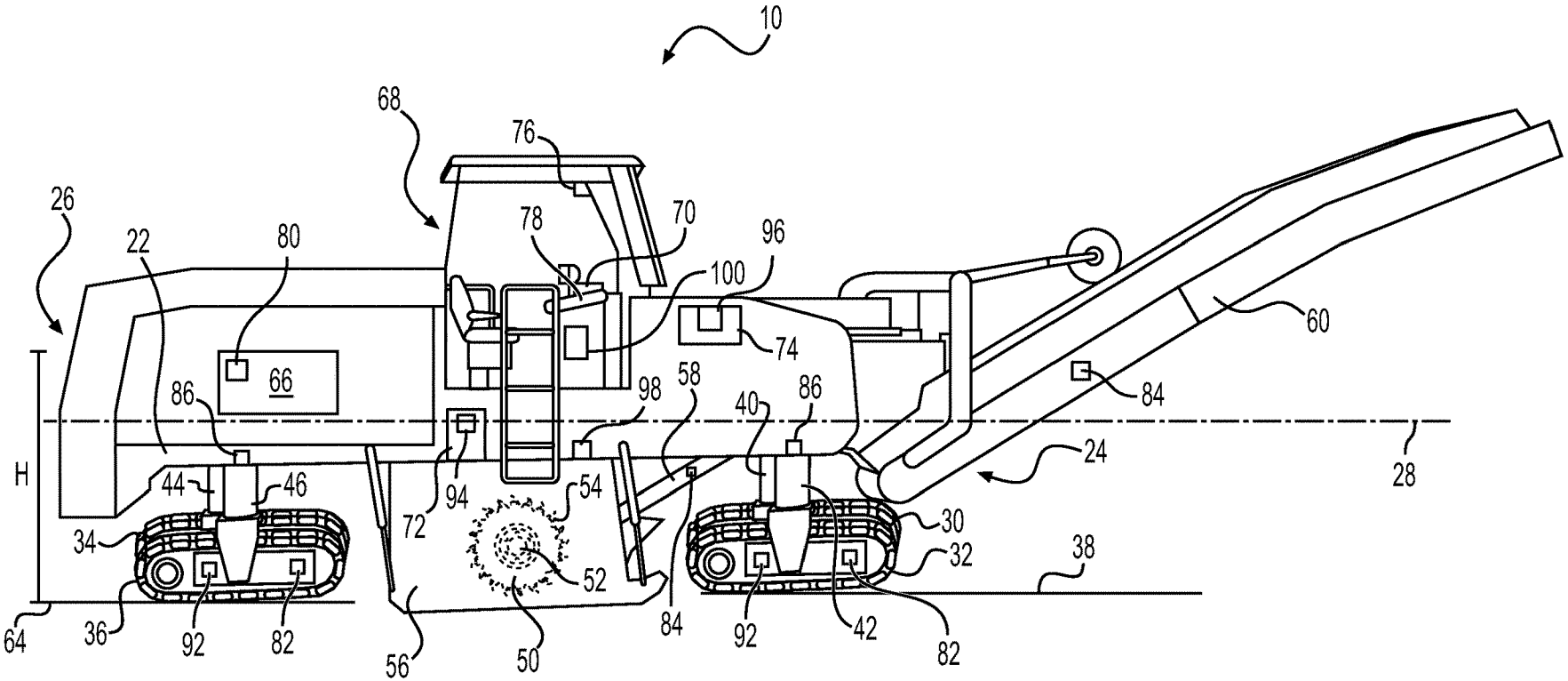
FIG. 1 is an illustration of an exemplary milling machine.
Figure 2:
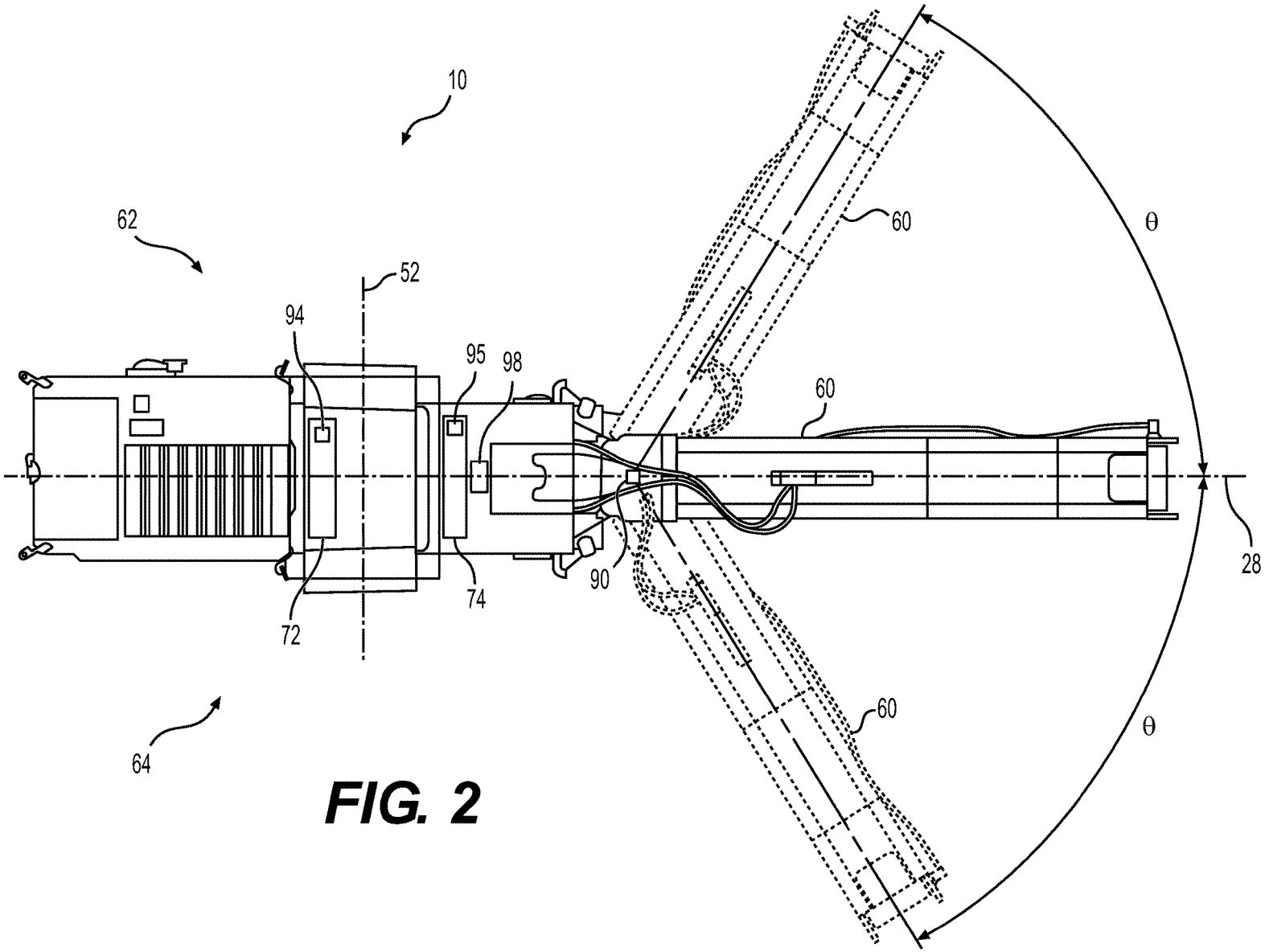
FIG. 2 is a top view illustration of the exemplary milling machine of FIG. 1.

FIGS. 1 and 2 illustrate exemplary milling machines 10 and 20, respectively. In one exemplary embodiment as illustrated in FIG. 1, milling machine 10 may be a cold planer, which may also be referred to as a cold milling machine, a scarifier, a profiler, etc. Milling machine 10 may include frame 22, which may extend from first end 24 to second end 26 disposed opposite first end 24. In some exemplary embodiments, first end 24 may be a front end and second end 26 may be a rear end of frame 22. Frame 22 may have any shape (e.g. rectangular, triangular, square, etc.) Frame 22 may have a longitudinal axis 28 extending in a generally forward-rearward travel direction of milling machine 10.

Frame 22 may be supported on one or more propulsion devices. For example, as illustrated in FIG. 1, frame 22 may be supported on propulsion devices 30, 32, 34, 36. Propulsion devices 30, 32, 34, 36 may be equipped with electric or hydraulic motors which may impart motion to propulsion devices 30, 32, 34, 36 to help propel milling machine 10 in a forward or rearward direction. In one exemplary embodiment as illustrated in FIG. 1, propulsion devices 30, 32, 34, 36 may take the form of tracks, which may include, for example, sprocket wheels, idler wheels, and/or one or more rollers that may support a continuous track. However, it is contemplated that propulsion devices 30, 32, 34, 36 of milling machine 10 may take the form of wheels (see e.g., FIG. 4). It is also contemplated that propulsion devices 30, 32, 34, 36, when in the form of wheels may also include one or more tires. In the present disclosure, the terms track and wheel will be used interchangeably and will include the other of the two terms.

Tracks 30, 32 may be located adjacent first end 24 of frame 22 and tracks 34, 36 may be located adjacent second end 26 of frame 22. Track 30 may be spaced apart from track 32 along a width direction of frame 22. Likewise, track 34 may be spaced apart from track 36 along a width direction of frame 22. In one exemplary embodiment as illustrated in FIG. 1, track 30 may be a left front track, track 32 may be a right front track, track 34 may be a left rear track, and track 36 may be a right rear track. Some or all of propulsion devices 30, 32, 34, 36 may also be steerable, allowing milling machine 10 to be turned towards the right or left during a forward or rearward motion on ground surface 38. Although milling machine 10 in FIG. 1 has been illustrated as including four tracks 30, 32, 34, 36, it is contemplated that in some exemplary embodiments, milling machine 10 may have only one rear track 34 or 36, which may be located generally centered along a width of frame 22.

Frame 22 may be connected to tracks 30, 32, 34, 36 by one or more leg columns 40, 42, 44, 46. For example, as illustrated in FIG. 1, frame 22 may be connected to left front track 30 via leg column 40 and to right front track 32 via leg column 42. Likewise, frame 22 may be connected to left rear track 34 via leg column 44 and to right rear track 36 via leg column 46. One or more of leg columns 40, 42, 44, 46 may be height adjustable such that a height of frame 22 relative to one or more of tracks 30, 32, 34, 36 may be increased or decreased by adjusting a length of one or more of leg columns 40, 42, 44, 46, respectively. It will be understood that adjusting a height of frame 22 relative to one or more of tracks 30, 32, 34, 36 would also adjust a height of frame 22 relative to ground surface 38 on which tracks 30, 32, 34, 36 may be supported.

Milling machine 10 may include milling drum 50, which may be attached to frame 22 between front end 24 and rear end 26. Milling drum 50 may extend along transverse axis 52 (see also e.g., FIG. 2) of frame 22. Milling drum 50 may include cutting tools 54 (or teeth 54) that may be configured to cut into and tear up a predetermined thickness of a roadway or the ground. A height of milling drum 50 relative to the ground surface 38 may be adjusted by adjusting a height of one or more leg columns 40, 42, 44, 46. As milling drum 50 rotates, teeth 54 of milling drum 50 may come into contact with the ground or roadway surface 38, thereby tearing up or cutting the ground or roadway surface 38. Milling drum 50 may be enclosed within drum chamber 56 which may help contain the material removed by teeth 54 from the ground or roadway surface 38. Milling machine 10 may include one or more conveyors 58, 60, which may help transport the material removed by milling drum 50 to an adjacent vehicle such as a dump truck.

As illustrated in FIG. 2, at least conveyor 60 may be rotated or slewed towards left side 62 or right side 64 of milling machine 10. It is to be understood that left side 62 and right side 64 may be determined relative to a forward movement direction of milling machine 10. As illustrated in FIG. 2, conveyor 60 may be slewed by slew angle θ relative to longitudinal axis 28 on either side (e.g., left side 62 or right side 64) of longitudinal axis 28. Slewing conveyor 60 in this manner may allow material removed by milling drum 50 from ground surface 38 to be directed to a dump truck that may travel alongside milling machine 10 on either left side 62 or right side 64 of milling machine 10.

Returning to FIG. 1, milling machine 10 may include engine 66, which may be attached to frame 22. Engine 66 may be any suitable type of internal combustion engine, such as a gasoline, diesel, natural gas, or hybrid-powers engine. It is contemplated, however, that in some exemplary embodiments, engine 66 may be driven by electrical power. Engine 66 may be configured to deliver rotational power output to one or more hydraulic motors associated with propulsion devices 30, 32, 34, 36, to milling drum 50, and to the one or more conveyors 58, 60. Engine 66 may also be configured to deliver power to operate one or more other components or accessory devices (e.g. pumps, fans, motors, generators, belt drives, transmission devices, etc.) associated with milling machine 10.

Milling machine 10 may include operator platform 68, which may be attached to frame 22. In some exemplary embodiments, operator platform 68 may be in the form of an open-air platform that may or may not include a canopy. In other exemplary embodiments, operator platform 68 may be in the form of a partially or fully enclosed cabin. As illustrated in FIG. 1, operator platform 68 may be located at a height "H" above ground surface 38. In some exemplary embodiments, height H may range between about 2 ft to 10 ft above ground surface 38. Operator platform 68 may include operator console 70. Operator console 70 may include one or more controls or input devices, which may be used by an operator to operate and/or control milling machine 10. The one or more input devices may take the form of buttons, switches, sliders, levers, wheels, touch screens, or other input/output or interface devices.

Milling machine 10 may also include fuel tank 72 and water tank 74. In one exemplary embodiment as illustrated in FIG. 1, fuel tank 72 may be located under operator platform 68 and water tank 74 may be located in front of operator platform 68. It is to be understood, however, that fuel tank 72 and water tank 74 may be located anywhere else on milling machine 10.

Milling machine 10 may also include alarm device 76 that may be located in operator platform 68. In one exemplary embodiment alarm device 76 may be an audible alarm or a speaker configured to generate an audible alarm or audible message. Additionally or alternatively, alarm device 76 may include one or more visual indicators (e.g., lights or displays) included on operator console 70 in operator platform 68. It is further contemplated that in some embodiments, alarm device 76 may additionally or alternatively include display device 78 on operator console 70. Display device 78 may include one or more of a cathode ray tube, a liquid crystal display, a light emitting diode display, a touch-screen display or any other type of display device configured to display one or more symbols, or textual or graphical displays to an operator of milling machine 10.

Milling machine 10 may be equipped with numerous sensors, some of which may be configured to determine operational parameters (e.g., engine speed, ground speed, milling drum speed, conveyor speed, acceleration, temperature, pressure, etc.) of milling machine 10. For example, milling machine 10 may be equipped with engine speed sensor 80, ground speed sensor 82, and conveyor speed sensor 84. Engine speed sensor 80 may be configured to measure, for example, a rotational speed of engine 66 (e.g., in revolutions per minute or rpm). Ground speed sensor 82 may be configured measure a speed of milling machine 10 in the forward or rearward directions relative to ground surface 38 (e.g., in m/s, Km/h, or mph). In one exemplary embodiment, each of propulsion devices 30, 32, 34, 36 may be equipped with one or more ground speed sensors 82 configured to determine a speed of each of propulsion devices 30, 32, 34, 36 relative to ground surface 38. It is contemplated, however, that ground speed of milling machine 10 or 20 may be determined in other ways, for example, using GPS sensors, inertial sensors, flow rate or pressure of hydraulic fluid in hydraulic motors associated with propulsion devices 30, 32, 34, 36, etc.

Each of conveyors 58, 60 may be equipped with conveyor speed sensor 84, which may be configured to determine a linear speed of conveyors 58, 60 (in m/s or ft/s). It is also contemplated that in some embodiments, conveyor speed sensor 84 may be a rotational speed sensor associated with one or more rollers configured to move conveyors 58, 60, and the linear speed of conveyors 58, 60 may be determined from the measured rotational speed of the rollers. Sensors 80, 82, 84, etc. may be operational sensors configured to measure operational parameters associated with operation of engine 66, propulsion devices 30, 32, 34, 36, conveyors 58, 60, etc. It is contemplated that milling machine 10 may include many additional operational sensors, for example, milling drum speed sensors, temperature sensors to measure a temperature of an engine coolant, temperature sensors to measure temperatures of cutting teeth 54, and/or other sensors to measure flow rate, pressure, and/or temperature of hydraulic fluid being supplied to various implements of milling machine 10, etc.

Milling machine 10 may also include one or more configuration sensors that may be configured to measure configuration parameters associated with milling machine 10. Configuration parameters may provide information regarding a position or configuration of one or more components of milling machine 10. For example, configuration parameters may include height of one or more of leg columns 40, 42, 44, 46, slew angle of conveyor 60 relative to axis 28, steering angle of one or more of propulsion devices 30, 32, 34, 36, level of fuel in fuel tank 72, level of water in water tank 74, position of one or more optionally attached implements (e.g., additional water tanks, pumps, generators, external sensors, structural beams, etc.). As illustrated in FIGS. 1 and 2, for example, milling machine 10 may include one or more height sensors 86, slew angle sensor 90 (see FIG. 2), one or more steering angle sensors 92, fuel level sensor 94, and water level sensor 96. It is contemplated that milling machine 10 may include other configuration sensors (e.g., distance sensors, weight sensors, etc.)

Height sensor 86 may be configured to determine a height of frame 22 relative to ground surface 38 adjacent leg column 40, 42, 44, and/or 46. Height sensor 86 may include one or more of laser sensors, ultrasonic sensors, capacitive, or inductive sensors capable of measuring a length of one or more of leg columns 40, 42, 44, and/or 46. A height of frame 22 may be determined based on the measured lengths of the one or more leg columns 40, 42, 44, and/or 46 and geometric information regarding frame 22 and/or one or more of propulsion devices 30, 32, 34, and/or 36. It is also contemplated that in some embodiments, height sensors 86 may include one or more ultrasonic sensors configured to directly measure a height of frame 22 relative to ground surface 38. In other exemplary embodiments, height sensors 86 may include one or more of GPS sensors, inertial sensors, or other position sensors configured to determine a height of frame 22 relative to ground surface 38.

Slew angle sensor 90 may be configured to measure slew angle θ of conveyor 60 relative to longitudinal axis 28. In one embodiment, slew angle sensor 90 may include a rotational sensor disposed at or adjacent to a pivotable connection between conveyor 60 and frame 22. Slew angle sensor 90 may be configured to measure an amount of rotation of conveyor 60 in a leftward or rightward transverse direction (e.g., transverse to longitudinal axis 28). One or more of propulsion devices 30, 32, 34, 36 may include steering angle sensors 92. Steering angle sensors 92 may be configured to measure an angle of rotation of propulsion devices 30, 32, 34, or 36, in a transverse direction relative to longitudinal axis 28.

Fuel level sensor 94 may be configured to measure a height of fuel relative to a base of fuel tank 72. It is also contemplated that fuel level sensor 94 may be configured to measure an inclination of a free surface of the fuel in fuel tank 72 relative to the base of fuel tank 72. In some embodiments, fuel level sensor 94 may be configured to determine a volume of fuel in fuel tank 72 and a height of the fuel relative to the base of fuel tank 72 may be determined based on the measured volume of fuel and geometrical characteristics of fuel tank 72. Water level sensor 96 may be configured to measure a height of water in water tank 74 relative to a base of water tank 74. In some embodiments, water level sensor 96 may be configured to determine a volume of water in water tank 74 and a height of the water relative to the base of water tank 74 may be determined based on the measured volume of water and geometrical characteristics of water tank 74. It is also contemplated that water level sensor 96 may be configured to measure an inclination of a free surface of the water in water tank 74 relative to the base of fuel tank 72.

Figure 3:
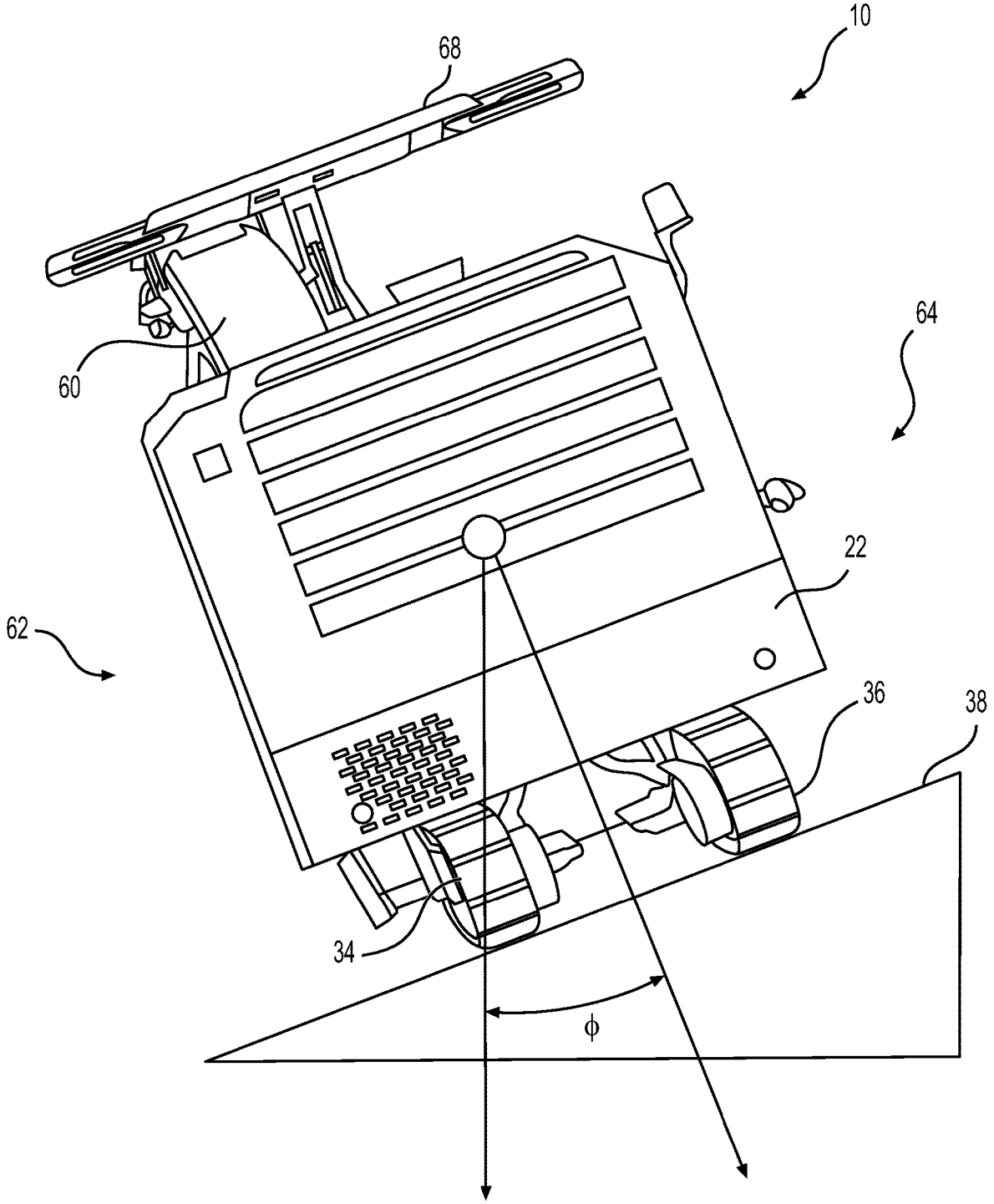
FIG. 3 is a back end view illustration of the exemplary milling machine of FIG. 1 on an inclined ground surface.

Milling machine 10 may also be equipped with slope sensor 98 that may be configured to determine a cross-slope of frame 22 (e.g., slope in a transverse or left-right direction) along transverse axis 52 of milling machine 10. In one exemplary embodiment, slope sensor 98 may be configured to determine roll angle $\phi$ (e.g., inclination or cross-slope) of frame 22 in the left-right or transverse direction, relative to a gravity direction. FIG. 3 illustrates an exemplary position of milling machine 10 on an inclined ground surface 38. As illustrated in FIG. 3, frame 22 of milling machine 10 may be inclined in a transverse direction (e.g., left-right direction) by an angle $\phi$ relative to the gravity direction. In one exemplary embodiment, slope sensor 98 may be configured to measure angle $\phi$. It is also contemplated that in some embodiments, slope sensor 98 may be configured to determine a pitch angle (e.g. inclination of frame 22 in a forward-rearward direction relative to longitudinal axis 28). It is further contemplated that slope sensor 98 may include an inertial measurement unit (IMU) and/or a global positioning system (GPS) sensor. It is also contemplated that additionally or alternatively, pitch angle of frame 22 may be determined based on heights of frame 22 relative to ground surface 38 measured by one or more height sensors 86 and based on geometrical parameters of milling machine 10.

Milling machine 10 may include controller 100, which may be configured to receive inputs, data, and/or signals from the one or more input devices, sensors 80, 82, 84, 86, 90, 92, 94, 96, 98, etc., and/or other sensors associated with milling machine 10. Controller 100 may include or be associated with one or more processors, memory devices, and/or communication devices. Controller 100 may embody a single microprocessor or multiple microprocessors, digital signal processors (DSPs), application-specific integrated circuit devices (ASICs), etc. Numerous commercially available microprocessors may be configured to perform the functions of controller 100. Various other known circuits may be associated with controller 100, including power supply circuits, signal-conditioning circuits, and communication circuits, etc.

The one or more memory devices associated with controller 100 may store, for example, data and/or one or more control routines, instructions, mathematical models, algorithms, machine learning models, etc. The one or more memory devices may embody non-transitory computer-readable media, for example, Random Access Memory (RAM) devices, NOR or NAND flash memory devices, and Read Only Memory (ROM) devices, CD-ROMs, hard disks, floppy drives, optical media, solid state storage media, etc. Controller 100 may execute one or more routines, instructions, mathematical models, algorithms, and/or machine learning models stored in one or more memory devices to generate and deliver one or more command signals to one or more of propulsion devices 30, 32, 34, 36, engine 66, milling drum 50, conveyors 58, 60, and/or other implements and components of milling machine 10.

Figure 4:
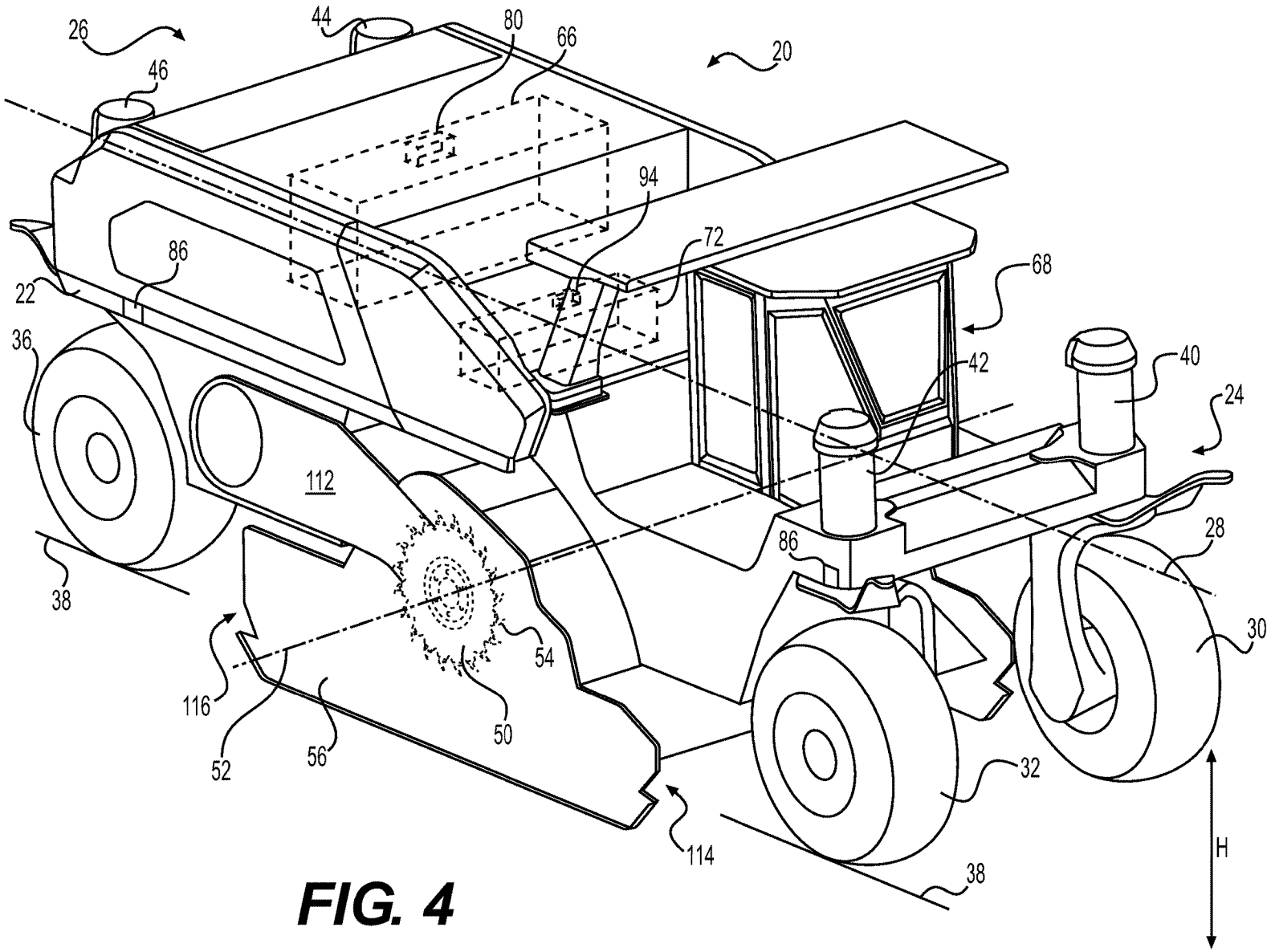
FIG. 4 is an illustration of another exemplary milling machine.

FIG. 4 illustrates another exemplary embodiment of a milling machine 20. In one exemplary embodiment as illustrated in FIG. 4, milling machine 20 may be a reclaimer, which may also be called soil stabilizer, reclaiming machine, road reclaimer, etc. Like milling machine 10, milling machine 20 may include frame 22, propulsion devices in the form of wheels 30, 32, 34 (not visible in FIG. 2), 36, and leg columns 40, 42, 44, 46. In some exemplary embodiments, one or more leg columns 40, 42, 44, 46 may be height adjustable such that a height of frame 22 relative to one or more of wheels 30, 32, 34, 36 may be increased or decreased by adjusting a length of one or more leg columns 40, 42, 44, 46, respectively. As illustrated in FIG. 2, leg column 40 may connect frame 22 to the left front wheel 30, leg column 42 may connect frame 22 to a right front wheel 32, leg column 44 may connect frame 22 to left rear wheel 34 (not visible in FIG. 2), and leg column 46 may connect frame 22 to right rear wheel 36. Although, milling machine 20 has been illustrated in FIG. 2 as including wheels 30, 32, 34, 36, it is contemplated that milling machine 20 may instead include tracks 30, 32, 34, 36. One or more of wheels 30, 32, 34, 36 may be steerable, allowing milling machine 20 to be turned towards the right or left during a forward or rearward motion on ground surface 38.

Milling drum 50 of milling machine 20 may be located between first end 24 and second end 26. Milling drum 50 may extend along transverse axis 52. In one exemplary embodiment as illustrated in FIG. 4, milling drum 50 of milling machine 20 may not be directly attached to frame 22. Instead, as illustrated in FIG. 4 milling drum 50 of milling machine 20 may be attached to frame 22 via arms 112. Arms 112 may include a pair of arms (only one of which is visible in FIG. 2) disposed on either side of milling machine 20. Arms 112 may be pivotably attached to frame 22 and may be configured to be rotatable relative to frame 22 about an axis generally parallel to transverse axis 52. One or more actuators may be connected between frame 22 and arms 112 and may be configured to move arms 112 relative to frame 22. Thus, unlike milling machine 10, milling drum 50 of milling machine 20 may be movable relative to frame 22. It is contemplated, however, that in other exemplary embodiments, milling drum 50 may be directly attached to frame 22 of milling machine 20 in a manner similar to that described above for milling machine 10.

Milling drum 50 of milling machine 20 may include cutting tools 54 (or teeth 54). A height of milling drum 50 above the ground surface may be adjusted by rotating arms 112 relative to frame 22 and/or by adjusting one or more of leg columns 40, 42, 44, 46. As milling drum 50 rotates, teeth 54 may come into contact with and tear or cut the ground or roadway surface 38. Milling drum 50 may be enclosed within drum chamber 56 which may help contain the material removed by teeth 54 from the ground or roadway surface. Rotation of milling drum 50 may cause the removed material to be transferred from adjacent front end 114 of drum chamber 56 towards rear end 116 of drum chamber 56. Stabilizing components such as ash, lime, cement, water, etc. may be mixed with the removed material and the reconstituted mixture of the milled material and the stabilizing components may be deposited on ground surface 38 adjacent rear end 116 of drum chamber 56.

Like milling machine 10, milling machine 20 may also include engine 66, operator platform 68, operator console 70 with one or more control or input devices, fuel tank 72, water tank 74, alarm device 76, controller 100, and one or more sensors 84, 92, 94, 96, 98, all of which may have characteristics similar to those discussed above with respect to milling machine 10. However, unlike milling machine 10, milling machine 20 may not include conveyors 58, 60, and sensors 86 and 90. Additionally, it will be understood that as used in this disclosure the terms front and rear are relative terms, which may be determined based on a direction of travel of milling machine 10 or 20. Likewise, it will be understood that as used in this disclosure, the terms left and right are relative terms, which may be determined based on facing the direction of travel of milling machine 10 or 20.

As discussed above, controller 100 may receive one or more input signals from the one or more input devices associated with operator console 70 and/or one or more of sensors 82, 84, 86, 90, 92, 94, 96, 98, etc. Controller 100 may be configured to determine a threshold roll angle $\phi_A$. Threshold roll angle $\phi_A$ may be variable and may depend on one or more machine configuration parameters. The threshold roll angle $\phi_A$ may represent an angle at which milling machine 10 or 20 may be more than 50% likely to tip over when milling machine 10 or 20 is inclined at a roll angle $\phi \geq$threshold roll angle $\phi_A$. Controller 100 may be configured to determine the threshold roll angle $\phi_A$ based on one or more of various configuration parameters, such as, fuel level in fuel tank 72, water level in water tank 74, steering angle of one or more of propulsion devices 30, 32, 34, 36, slew angle $\theta$ of conveyor 60 relative to longitudinal axis 28, pitch angle of frame 22 relative to ground surface 38, and/or heights of one or more of leg columns 40, 42, 44, 46.

In one exemplary embodiment, controller 100 may be configured to determine threshold roll angle $\phi_A$ by determining a center of gravity of fuel remaining in fuel tank 82 based on measurements received from fuel level sensor 94. Additionally or alternatively, controller 100 may be configured to determine threshold roll angle $\phi_A$ by determining a center of gravity of water remaining in water tank 74 based on measurements received from water level sensor 96. It is also contemplated that controller 100 may additionally or alternatively determine a center of gravity of milling machine 10 or 20 based on slew angle $\theta$ of conveyor 60 based on measurements received from slew angle sensor 90, steering angles of one or more propulsion devices 30, 32, 34, 36 based on measurements from one or more steering angle sensor 92, and/or heights of frame 22 based on measurements received from one or more height sensors 86. Controller 100 may use one or more of look-up tables, correlations, mathematical models, algorithms, etc., to determine threshold roll angle $\phi_A$ based on measurements from one or more of configuration sensors 86, 90, 92, 94, 96, 98, etc.

In one exemplary embodiment, controller 100 may be configured to determine a plurality of threshold angles $\phi_i$ (i=1, 2, 3, . . . m) corresponding to one or more of the configuration parameters associated with milling machine 10 or 20. For example, controller 100 may determine threshold angle $\phi_1$ based on an angle of frame 22 relative to ground surface 38 based on measurements from one or more height sensors 86 or based on measurements from slope sensor 98. Controller 100 may also determine, for example, threshold angle $\phi_2$ based on fuel level in fuel tank 72, threshold angle $\phi_3$ based on water level in water tank 74, threshold angle $\phi_4$ based on slew angle of conveyor 60, threshold angle $\phi_5$ based on steering angles of one or more propulsion devices 30, 32, 34, 36, threshold angle $\phi_6$ based on a pitch angle of frame 22, etc. Controller 100 may be configured to determine threshold roll angle $\phi_A$ based on one or more of threshold angles $\phi_1$, $\phi_2$, $\phi_3$, $\phi_4$, $\phi_5$, $\phi_6$, etc. It is contemplated that controller 100 may uses one or more of look-up tables, correlations, mathematical expressions, statistical methods, etc. to determine threshold roll angle $\phi_A$ based on one or more of threshold roll angles $\phi_1$, $\phi_2$, $\phi_3$, $\phi_4$, $\phi_5$, or $\phi_6$. It is contemplated that in one exemplary embodiment, controller 100 may determine threshold roll angle $\phi_A$ as a minimum of threshold angles $\phi_i$ (i=1, 2, 3, . . . m) (e.g., minimum of $\phi_1$, $\phi_2$, $\phi_3$, $\phi_4$, $\phi_5$, $\phi_6$, etc.).

It is also contemplated that in some exemplary embodiments, controller 100 may execute one or more machine learning models to determine threshold roll angle $\phi_A$. For example, controller 100 may be provided with training data, including one or more of the various configuration parameters discussed above and/or their combinations together with the corresponding values of threshold roll angle $\phi_A$. Controller 100 may train the machine learning model using the training data. During operation of milling machine 10 or 20, controller 100 may determine various configuration parameters based on one or more of the configuration sensors discussed above. Further controller 100 may execute the trained machine learning model to determine threshold roll angle $\phi_A$ based on the one or more measured configuration parameters.

Controller 100 may be configured to compare the roll angle $\phi$ (e.g., cross-slope angle or inclination) of milling machine 10 or 20 determined by slope sensor 98 with threshold roll angle $\phi_A$. When roll angle $\phi$ of milling machine 10 or 20 equals or exceeds threshold roll angle $\phi_A$ ($\phi \geq \phi_A$), controller 100 may be configured to activate alarm device 76. For example, in one exemplary embodiment, controller 100 may be configured to cause alarm device 76 to generate an audible alarm or warning message, indicating that milling machine 10 or 20 is likely to tip over. Additionally or alternatively, controller 100 may be configured to activate one or more visual indicators (e.g., lights) on operator console 70 in operator platform 68 to alert the operator, regarding likelihood that milling machine 10 or 20 will tip over. It is also contemplated that controller 100 may be configured to activate alarm device 76 by displaying one or more symbols or graphical displays to alert the operator to a potential tip over condition on one or more display devices 78 associated with operator console 70.

Figure 5:
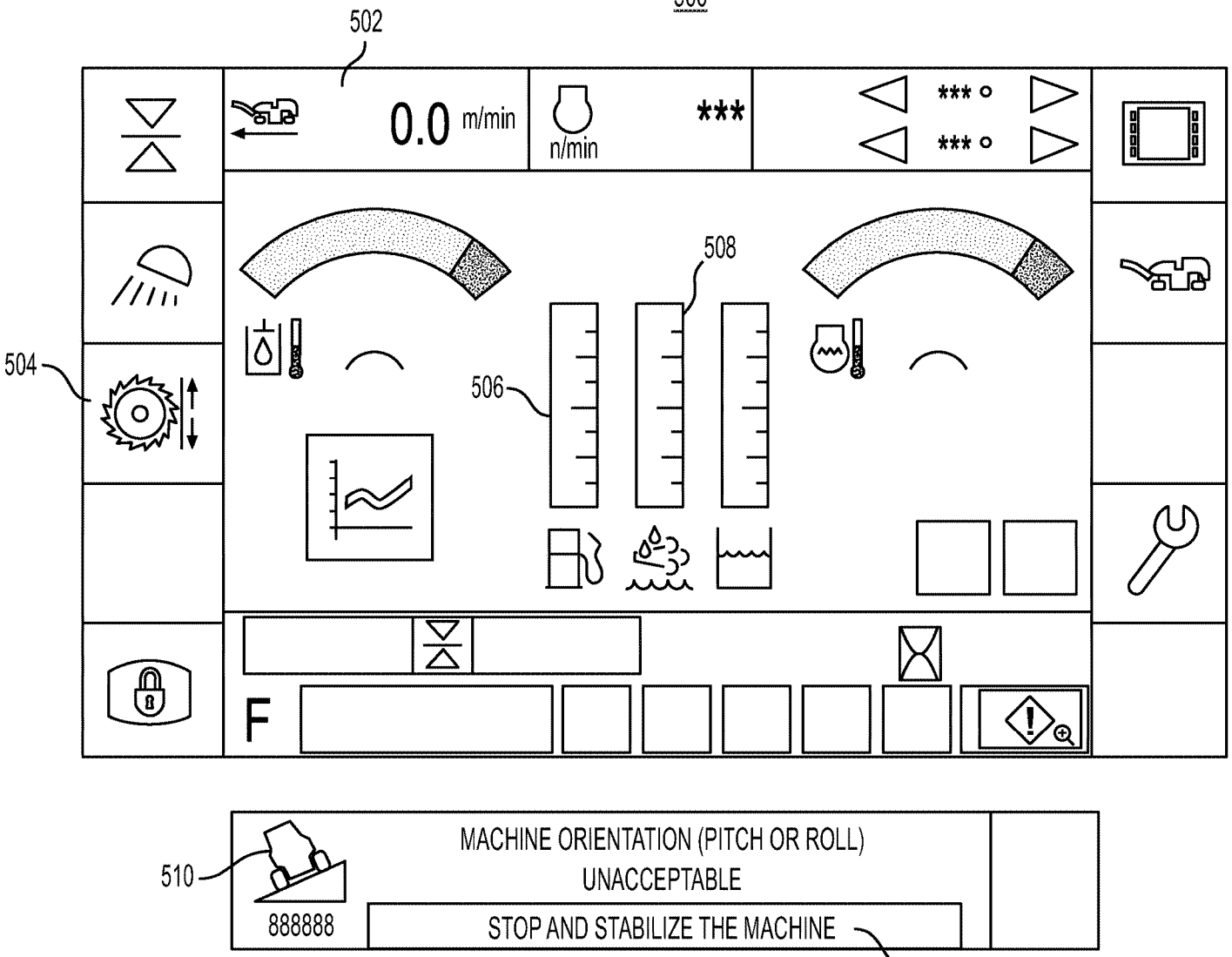
FIG. 5 is an illustration of an exemplary graphical display for the milling machines of FIGS. 1 and 4.

FIG. 5 illustrates an exemplary graphical display 500 that may be generated by controller 100 for display on display device 78. Display 500 may include element 502 that may display a ground speed of milling machine 10 or 20, element 504 that may display a milling depth, element 506 that may display a fuel level of the fuel in fuel tank 72, element 508 that may display a water level of the water in water tank 74, and element 510 that may display a current inclination of milling machine 10 or 20 relative to ground surface 38. Display 500 may be configured to display other parameters (e.g., sensor readings, calculated values, etc.) associated with milling machines 10 or 20. When roll angle $\phi$ of milling machine 10 or 20 equals or exceeds threshold roll angle $\phi_A$, controller 100 may display the warning message 512 (e.g., STOP AND STABILIZE THE MACHINE) to an operator of milling machine 10 or 20. Additionally or alternatively, controller 100 may change a color of element 510 or display element 510 in different colors or in a flashing manner to attract the operator's attention. It should be understood that display 500 is exemplary and it is contemplated that many other types of graphical displays may be used to display one or more operational parameters, one or more configuration parameters and/or one or more visual alerts on display device 78 to an operator of milling machine 10 or 20. It is to be understood that the text of the warning message discussed above and illustrated in the figures is exemplary and nonlimiting, and many other types of warning messages may be displayed on graphical display 500.

In some embodiments, controller 100 may be configured to additionally or alternatively compare roll angle $\phi$ of milling machine 10 or 20 determined by slope sensor 98 with threshold roll angle $\phi_B$ that may be different from threshold roll angle $\phi_A$. Threshold roll angle $\phi_B$ may be a fixed angle that may not depend on a current measurement of one or more of the configuration parameters of milling machine 10 or 20. Threshold roll angle $\phi_B$ may be greater than threshold roll angle $\phi_A$. Threshold roll angle $\phi_B$ may represent an angle of inclination at which there is a high likelihood (e.g., greater than 90%, greater than 95%, etc.) that milling machine 10 or 20 may tip over. In some exemplary embodiments, threshold roll angle $\phi_B$ may be determined by performing tilt table testing on milling machines 10 or 20. When roll angle $\phi$ of milling machine 10 or 20 exceeds threshold roll angle $\phi_B$, controller 100 may be configured to activate alarm device 76. It is contemplated that alarm device 76 may generate audible and/or visual alerts that may be the same as or different from the condition discussed above, where milling machine 10 or 20 had a roll angle $\phi$ greater than or equal to threshold roll angle $\phi_A$ but smaller than threshold roll angle $\phi_B$. In some exemplary embodiments, when milling machine 10 or 20 has roll angle $\phi$ that is equal to or greater than threshold roll angle $\phi_B$, controller 100 may also be configured to stop engine 66 to minimize damage to the engine and/or other components of milling machine 10 or 20 that may be caused as a result of milling machine 10 or 20 tipping over. It is to be understood that it may be possible to manually restart engine 66 on a tipped over milling machine 10 or 20 to allow engine 66 to provide power to one or more components that may help to restore milling machine 10 or 20 to an upright position from a tipped over position.

In some embodiments, controller 100 may be configured to additionally or alternatively compare roll angle $\phi$ of milling machine 10 or 20 determined by slope sensor 98 with threshold roll angle $\phi c$ that may be different from threshold roll angles $\phi_A$ and $\phi_B$. Threshold roll angle $\phi_C$ may be smaller than threshold roll angle $\phi_A$ and may represent a safety threshold. For example, a ratio of threshold roll angle $\phi_C$ and threshold roll angle $\phi_A$ may be a predetermined value (e.g., 0.75, 0.85, 0.90, etc.). That is, controller 100 may determine threshold roll angle $\phi_C$ as a predetermined percentage (less than 100) of threshold roll angle $\phi_A$. When controller 100 determines that roll angle $\phi$ of milling machine 10 or 20 is greater than or equal to threshold roll angle $\phi_C$, but less than threshold roll angle $\phi_A$, controller 100 may be configured to adjust maximum and/or minimum limits for particular configuration parameters. In one exemplary embodiment, controller 100 may reduce the upper limit $\theta_{max}$ of slew angle $\theta$. For example, if $\theta_{max}$ is ±45° for milling machine 10 on a level ground surface 38, controller 100 may reduce $\theta_{max}$ to ±15°, when roll angle $\phi$ of milling machine 10 is greater than or equal to threshold roll angle $\phi_C$. Thus, controller 100 may prevent an operator from rotating conveyor 60 in the transverse direction by more than the modified angle $\theta_{max}$, reducing the likelihood the milling machine 10 may tip over. As another example, controller 100 may limit a maximum allowable steering angle. Doing so may prevent an operator from excessively turning one or more of propulsion devices 30, 32, 34, 36, reducing the likelihood of making sharp turns of milling machine 10 or 20 on an inclined ground surface 38, which in turn may reduce the likelihood of tipping over for milling machine 10 or 20. As another example, controller may limit a maximum allowable pitch angle for frame 22. Doing so may prevent an operator from excessively inclining machine frame 22 relative to ground surface 38, thereby reducing the likelihood of tipping over for milling machine 10 or 20. It is contemplated that controller 100 may determine the modified limits of the one or more configuration parameters (e.g., $\theta_{max}$) using look-up tables, correlations, mathematical models, algorithms, etc., based on measured values of various configuration parameters. Controller 100 may be configured repeatedly monitor the one or more sensors, determine and update the threshold roll angles $\phi_A$ and/or $\phi_C$, and compare the roll angle $\phi$ of milling machine 10 or 20 with the threshold roll angles $\phi_A$, $\phi_B$, and/or $\phi_C$ during operation of milling machine 10.

A method of operating the disclosed milling machine 10 or 20 is described in more detail with respect to FIG. 6 below.

INDUSTRIAL APPLICABILITY

The tip over warning system of the present disclosure may be used to continuously monitor a cross-slope $\phi$ of milling machine 10 or 20 to reduce the likelihood that milling machine 10 or 20 may tip over when operating on an inclined ground surface 38. In particular, controller 100 of milling machine 10 or 20 may compare the cross-slope $\phi$ of milling machine 10 or 20 with one or more threshold roll angles $\phi_A$, $\phi_B$, or $\phi_C$ and take various actions to either reduce a likelihood of a tip over of milling machine 10 or 20, or reduce damage to one or more machine components caused by a tip over of milling machine 10 or 20. An exemplary method of operation of the disclosed milling machines 10 or 20 having the disclosed tip over warning system will be discussed below.

Figure 6:
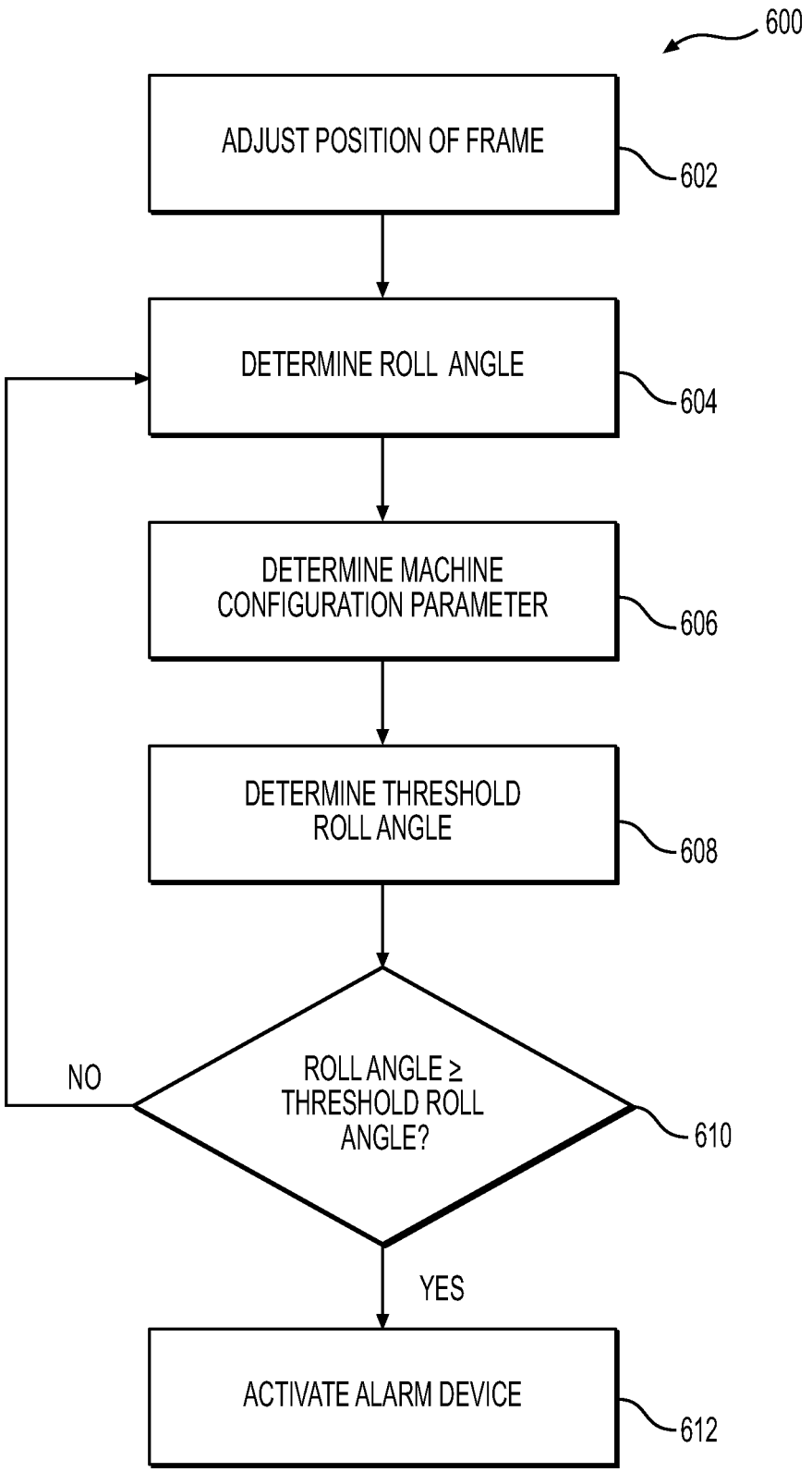
FIG. 6 is an exemplary method of operating the machines of FIGS. 1 and 4.

FIG. 6 illustrates an exemplary method 600 of operating milling machine 10 or 20 having the disclosed tip over warning system. The order and arrangement of steps of method 600 is provided for purposes of illustration. As will be appreciated from this disclosure, modifications may be made to method 600 by, for example, adding, combining, removing, and/or rearranging the steps of method 600. Method 600 may be executed by controller 100 by, for example, executing one or more instructions stored in a memory device associated with controller 100.

Method 600 may include a step of adjusting a position of frame 22 (Step 602). An operator may perform such an operation, for example, before beginning the milling operation using milling machine 10 or 20. The operator may do so to set, for example, a cutting depth for the milling drum. In one exemplary embodiment, the operator may initially lower one or more of leg columns 40, 42, 44, 46 until teeth 54 of milling drum 50 barely touch ground surface 38. At this point, operator may zero out all the depth and slope sensors associated with determining a milling depth of milling machine 10 or 20. It is to be understood that zeroing out the slope sensor before beginning a milling operation, however, does not zero out the roll angle signal corresponding to angle $\phi$, which indicates the inclination of frame 22 of milling machine 10 or 20 relative to a gravity direction. Next, the operator may lower one or more of leg columns 40, 42, 44, 46 so that teeth 54 begin cutting into ground surface 38 at a desired depth of cut.

Method 600 may include a step of determining a roll angle $\phi$ of milling machine 10 or 20 (Step 604). As discussed above, slope sensor 98 of milling machine 10 or 20 may continuously monitor a roll angle $\phi$ of milling machine 10 or 20 relative to a direction of gravity (see e.g., FIG. 3). Slope sensor 98 may send one or more signals, representative of roll angle $\phi$, to controller 100. Controller 100 may be configured to determine roll angle $\phi$ of milling machine 10 or 20 based on the signals received from slope sensor 98.

Method 600 may include a step of determining one or more machine configuration parameters (Step 606). As discussed above, the one or more configuration sensors 86, 90, 92, 94, 96, etc. may generate one or more signals representative of a configuration parameter associated with milling machine 10 or 20. For example, one or more height sensors 86 may generate signals representative of a height of frame 22 relative to ground surface 38. Controller 100 may be configured to determine a height and/or pitch of frame 22 relative to ground surface 38 based on signals from the one or more height sensors 86. Slew angle sensor 90 may generate signals representative of a slew angle of conveyor 60 relative to longitudinal axis 28. Controller 100 may be configured to determine a rotation angle of conveyor 60 relative to longitudinal axis 28 and/or a center of gravity of conveyor 60 based on signals from slew angle sensor 90. One or more steering angle sensors 92 may generate signals representative of a steering angle of one or more propulsion devices 30, 32, 34, 36. Controller 100 may be configured to determine a rotation angle of one or more of propulsion devices 30, 32, 34, 36 relative to longitudinal axis 28 based on signals from steering angle sensors 92.

Similarly, fuel level sensor 94 and water level sensor 96 may generate signals representative of a fuel level in fuel tank 72 and a water level in water tank 74, respectively. Controller 100 may be configured to determine the fuel level and water level based on signals from fuel level sensor 94 and water level sensor 96, respectively. In some embodiments, controller 100 may also be configured to determine a center of gravity of the remaining fuel in fuel tank 72 and/or a center of gravity of the remaining water in water tank 74 based on signals from fuel level sensor 94 and water level sensor 96, respectively.

Method 600 may include a step of determining a threshold roll angle (Step 608). As discussed above, controller 100 may be configured to determine one or more of threshold roll angles $\phi_A$ and/or $\phi_C$ based on signals received from one or more of configuration sensors 86, 90, 92, 94, and/or 96. Controller 100 may use one or more of look-up tables, correlations, geometric models, algorithms, etc., and/or one or more of the techniques discussed above to determine one or more of threshold roll angles $\phi_A$ and/or $\phi_C$.

Method 600 may include a step of determining whether roll angle $\phi$ of milling machine 10 or 20 is greater than or equal to a threshold roll angle, for example, $\phi_A$ (Step 610). When controller 100 determines that roll angle $\phi$ of milling machine 10 or 20 is greater than or equal to threshold roll angle $\phi_A$ (Step 610: YES), method 600 may proceed to step 612. When controller 100 determines that roll angle $\phi$ of milling machine 10 or 20 is less than threshold roll angle $\phi_A$ (Step 610: NO), method 600 may return to step 604.

In step 612, method 600 may include a step of activating an alarm device 76 (Step 612). For example, in one exemplary embodiment, controller 100 may be configured to cause alarm device 76 to generate an audible alarm or warning message. Additionally or alternatively, controller 100 may be configured to activate one or more visual indicators (e.g., lights) on operator console 70 in operator platform 68. It is also contemplated that controller 100 may be configured to activate alarm device 76 by displaying one or more symbols or graphical displays on one or more display devices 78 associated with operator console 70. It is contemplated that controller 100 may repeatedly execute steps 604-612 to continuously update the threshold roll angles $\phi_A$ and/or $\phi_C$ during operation of milling machine 10 or 20.

It will be apparent to those skilled in the art that various modifications and variations can be made to the disclosed milling machine and tip over warning system. Other embodiments will be apparent to those skilled in the art from consideration of the specification and practice of the disclosed milling machine and tip over warning system. It is intended that the specification and examples be considered as exemplary only, with a true scope being indicated by the following claims and their equivalents.

What is claimed is:

1. A milling machine, comprising:

a frame having a longitudinal axis;

a milling drum attached to the frame and extending along a transverse axis of the frame;

a plurality of ground engaging tracks configured to support the frame;

a plurality of height-adjustable leg columns connecting the frame to the tracks;

an engine configured to rotate the milling drum and propel the ground engaging tracks;

a slope sensor configured to measure a roll angle of the frame;

a speed sensor configured to measure a ground speed of the milling machine;

a configuration sensor configured to measure a machine configuration parameter;

an alarm device; and a controller configured to:

determine a threshold roll angle based on the machine configuration parameter, wherein the threshold roll angle corresponds to a predetermined probability of tipping over of the milling machine;

compare the roll angle with the threshold roll angle; and activate the alarm device when the roll angle is greater than or equal to the threshold roll angle.

2. The milling machine of claim 1, further including a conveyor extending from the frame and configured to be rotatable transverse to the longitudinal axis.

3. The milling machine of claim 2, wherein the configuration sensor includes at least one of a fuel level sensor configured to measure a fuel level in a fuel tank of the milling machine, a water level sensor configured to measure a water level in a water tank of the milling machine, a steering angle sensor configured to measure a steering angle of at least one of the ground engaging tracks relative to the longitudinal axis, or a slew angle sensor configured to measure a slew angle of the conveyor relative to the longitudinal axis.

4. The milling machine of claim 3, wherein the controller is configured to determine the threshold roll angle based on at least one of the fuel level, the water level, the steering angle, or the slew angle.

5. The milling machine of claim 3, wherein the controller is configured to:

determine a plurality of threshold angles based on respective ones of the fuel level, the water level, the steering angle, and the slew angle; and determine the threshold roll angle based on at least one of the plurality of threshold angles.

6. The milling machine of claim 5, wherein the controller is configured to determine the threshold roll angle as a minimum of the plurality of threshold angles.

7. The milling machine of claim 1, wherein the controller is further configured to:

determine a pitch angle of the frame; and determine the threshold roll angle based on the pitch angle.

8. The milling machine of claim 1, wherein the controller is configured to activate the alarm device by at least one of causing the alarm device to emit an audible alert, or causing the alarm device to display a visual alert on an operator console of the milling machine.

9. The milling machine of claim 8, wherein the visual alert includes at least one of a warning light on the operator console of the milling machine, or a warning symbol or message displayed on a display device included in the operator console.

10. The milling machine of claim 1, wherein the machine configuration parameter includes at least one of:

a center of gravity of the milling machine, a center of gravity of an amount of water in a water tank of the milling machine, a center of gravity of an amount of fuel in a fuel tank of the milling machine, or a center of gravity of at least one implement attached to the milling machine.

11. The milling machine of claim 1, wherein the threshold roll angle is a first threshold roll angle, and the controller is further configured to:

compare the roll angle with a second threshold roll angle greater than the first threshold roll angle, and when the roll angle is greater than or equal to the second threshold roll angle:

activate the alarm device, and stop the engine.

12. The milling machine of claim 11, wherein the first threshold roll angle is variable and the second threshold roll angle is fixed.

13. The milling machine of claim 1, wherein the threshold roll angle is a first threshold roll angle, and the controller is configured to adjust a limit of the machine configuration parameter when the roll angle is greater than or equal to a second threshold roll angle less than the first threshold roll angle.

14. The milling machine of claim 13, wherein the machine configuration parameter is one of a slew angle of a conveyor extending from the frame or a steering angle of at least one of the ground engaging tracks, and the controller is configured to adjust a respective one of a maximum slew angle of the conveyor or a maximum steering angle.

15. A method of operating a milling machine including a frame having a longitudinal axis and supported by a plurality of ground engaging tracks connected to the frame by a plurality of height adjustable leg columns, a milling drum attached to the frame, an engine, a speed sensor, a slope sensor, a configuration sensor, and a controller, the method comprising:

operating one or more of the leg columns to adjust a position of the frame relative to a ground surface;

determining a roll angle of the frame based on a signal from the slope sensor;

determining a machine configuration parameter based on a signal from the configuration sensor;

determining, using the controller, a threshold roll angle based on the machine configuration parameter, wherein the threshold roll angle corresponds to a predetermined probability of tipping over of the milling machine;

comparing, using the controller, the determined roll angle of the frame with the threshold roll angle; and activating an alarm device when the determined roll angle exceeds the threshold roll angle.

16. The method of claim 15, wherein determining the machine configuration parameter includes determining at least one of a fuel level in a fuel tank of the milling machine, a water level in a water tank of the milling machine, a steering angle of at least one of the ground engaging tracks relative to the longitudinal axis, or a slew angle of a conveyor relative to the longitudinal axis.

17. The method of claim 16, further including:

determining, using the controller, a plurality of threshold angles based on respective ones of the fuel level, the water level, the steering angle, and the slew angle; and determining the threshold roll angle based on the plurality of threshold angles.

18. The method of claim 17, further including determining the threshold roll angle as a minimum of the plurality of threshold angles.

19. The method of claim 16, wherein the threshold roll angle is a first threshold roll angle, and the method further includes, comparing, using the controller, the roll angle with a second threshold roll angle greater than the first threshold roll angle, when the roll angle is greater than the first threshold roll angle and less than the second threshold roll angle, activating the alarm device, and when the roll angle is greater than or equal to the second threshold roll angle activating the alarm device, and stopping the engine.

20. The method of claim 16, wherein the threshold roll angle is a first threshold roll angle, and the method further includes adjusting at least one of a maximum slew angle or a maximum steering angle when the roll angle is greater than or equal to a second threshold roll angle less than the first threshold roll angle.

* * * * *